US012789055B2

(12) United States Patent
Trahan et al.

(10) Patent No.: US 12,789,055 B2
(45) **Date of Patent: *Nov. 10, 2026**

(54) PUTTER-TYPE GOLF CLUB HEAD

(71) Applicant: SUMITOMO RUBBER INDUSTRIES, LTD., Kobe (JP)

(72) Inventors: Nick Trahan, Huntington Beach, CA (US); Thomas Carlson, Newport Beach, CA (US); Christopher R. Cooper, Orange, CA (US); Adam Sheldon, Long Beach, CA (US)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 16 days.

This patent is subject to a terminal disclaimer.

(21) Appl. No.: 18/511,116

(22) Filed: Nov. 16, 2023

(65) Prior Publication Data

US 2024/0082667 A1 Mar. 14, 2024

Related U.S. Application Data

(60) Continuation of application No. 16/288,502, filed on Feb. 28, 2019, now Pat. No. 11,850,482, which is a (Continued)

(51) Int. Cl.
*A63B 53/04* (2015.01)

(52) U.S. Cl.
CPC ..... *A63B 53/0487* (2013.01); *A63B 53/0408* (2020.08); *A63B 53/0412* (2020.08); *A63B 53/0441* (2020.08)

(58) Field of Classification Search
CPC ..... A63B 53/0412; A63B 53/0487
See application file for complete search history.

(56) References Cited

U.S. PATENT DOCUMENTS 1,291,967 A * 1/1919 McDougal ..... A63B 53/0487 D21/745
D58,209 S * 6/1921 Bacheller ..... D21/745
(Continued)

FOREIGN PATENT DOCUMENTS

CN 108261741 B * 9/2019 ..... A63B 53/04
JP 2006218080 A * 8/2006
(Continued)

OTHER PUBLICATIONS

May 12, 2016 Office Action issued in U.S. Appl. No. 14/166,289.
(Continued)

*Primary Examiner* — Alvin A Hunter
(74) *Attorney, Agent, or Firm* — Oliff PLC

(57) ABSTRACT

A putter-type golf club head that, when oriented in a reference position, includes a striking wall extending in the heel to toe direction and defines a substantially planar striking face for hitting a golf ball. A central elongate member is in communication with, and extends rearward from, the striking wall. An upper surface of the central elongate member includes a plurality of separate alignment elements. At least one of the plurality of alignment elements has an edge that extends substantially parallel to the striking face. The length of the parallel edge is substantially equivalent to the diameter of a golf ball.

20 Claims, 8 Drawing Sheets

Related U.S. Application Data continuation of application No. 15/481,902, filed on Apr. 7, 2017, now Pat. No. 10,252,124, which is a division of application No. 14/166,289, filed on Jan. 28, 2014, now Pat. No. 9,694,259.

(60) Provisional application No. 61/891,639, filed on Oct. 16, 2013.

(56) References Cited

U.S. PATENT DOCUMENTS

D205,041 S * 6/1966 Schmoyer ..... D10/64
3,333,854 A * 8/1967 White ..... A63B 53/0487 473/313
3,880,430 A * 4/1975 McCabe ..... A63B 69/3685 473/255
D235,568 S 6/1975 Cook
4,032,156 A 6/1977 Clarke
4,136,877 A 1/1979 Antonious
4,312,509 A 1/1982 Grant
4,390,184 A * 6/1983 Rudell ..... A63B 60/02 473/253
4,458,900 A * 7/1984 Antonious ..... A63B 53/0487 473/254
4,508,350 A * 4/1985 Duclos ..... A63B 53/0487 473/254
4,629,193 A * 12/1986 Pierman ..... A63B 69/3685 473/254
4,688,798 A 8/1987 Pelz
4,754,976 A * 7/1988 Pelz ..... A63B 53/0487 473/340
4,795,157 A * 1/1989 Bencriscutto ..... A63B 69/3685 473/251
4,964,639 A * 10/1990 Tucker ..... A63B 53/007 473/255
5,046,740 A 9/1991 D'Eath
5,167,414 A * 12/1992 Montgomery, III ..... A63B 53/0487 473/251
5,470,070 A 11/1995 Bendo
5,533,728 A * 7/1996 Pehoski ..... A63B 60/52 473/341
5,655,976 A 8/1997 Rife
5,676,603 A * 10/1997 Miller ..... A63B 69/3614 473/220
5,690,556 A * 11/1997 Condon ..... A63B 53/0487 473/252
5,716,290 A 2/1998 Baker et al.
D398,353 S * 9/1998 Wooten ..... D21/742
5,816,930 A 10/1998 Brown
5,827,130 A 10/1998 Jimenez et al.
D401,636 S * 11/1998 Duclos ..... D21/742
5,842,935 A * 12/1998 Nelson ..... A63B 53/0487 473/341
5,890,969 A 4/1999 Bechler
6,045,452 A * 4/2000 Ahn ..... A63B 53/0487 473/251
6,062,986 A * 5/2000 Kaise ..... A63B 53/0487 473/254
D429,297 S 8/2000 Hettinger
D441,042 S 4/2001 Hettinger
D443,320 S 6/2001 Breier et al.
D443,906 S 6/2001 Hettinger et al.
6,261,190 B1 * 7/2001 Ashcraft ..... A63B 53/0487 473/254
6,273,831 B1 8/2001 Dewanjee
D447,782 S 9/2001 Hettinger et al.
D449,085 S 10/2001 Breier et al.
D457,586 S 5/2002 Tang et al.
6,386,991 B1 * 5/2002 Reyes ..... A63B 53/0487 473/340
D458,656 S 6/2002 Tang et al.
6,422,949 B1 * 7/2002 Byrne ..... A63B 69/3688 473/200
6,422,950 B1 * 7/2002 Whitlam ..... A63B 53/02 473/340
D461,514 S 8/2002 Tang et al.
D461,515 S 8/2002 Tang et al.
D461,860 S 8/2002 Tang
D461,861 S 8/2002 Tang et al.
D462,100 S 8/2002 Breier et al.
D463,002 S 9/2002 Tang et al.
6,471,600 B2 * 10/2002 Tang ..... A63B 60/00 473/340
6,478,690 B2 11/2002 Helmstetter et al.
D467,985 S 12/2002 Tang et al.
6,506,125 B2 * 1/2003 Helmstetter ..... A63B 53/0487 473/340
D470,904 S 2/2003 Tang et al.
D471,245 S 3/2003 Tang et al.
D471,940 S 3/2003 Tang et al.
D472,594 S 4/2003 Tang et al.
D472,595 S 4/2003 Tang et al.
6,592,467 B1 7/2003 Gray
D481,089 S 10/2003 Breier et al.
6,663,497 B2 12/2003 Cameron
D485,320 S 1/2004 Breier et al.
D485,323 S 1/2004 Wagner et al.
D485,592 S 1/2004 Hettinger et al.
6,679,782 B2 * 1/2004 Tang ..... A63B 53/04 473/340
D486,194 S 2/2004 Helmstetter et al.
6,685,577 B1 * 2/2004 Scruggs ..... C22C 45/10 473/345
6,692,372 B1 2/2004 Colucci
6,692,378 B2 2/2004 Shmoldas et al.
D488,200 S 4/2004 Olsavsky et al.
6,716,110 B1 * 4/2004 Ballow ..... A63B 60/02 473/340
D496,417 S 9/2004 Tang
D496,418 S 9/2004 Tang et al.
6,793,588 B2 * 9/2004 Tang ..... A63B 60/00 473/340
D499,777 S * 12/2004 Yamamoto ..... D21/742
6,837,801 B1 * 1/2005 Souza ..... A63B 53/0487 473/340
D505,703 S 5/2005 Fiskari
D506,237 S 6/2005 Byrne et al.
6,905,420 B2 6/2005 Tang et al.
D507,319 S * 7/2005 Kramski ..... D21/744
D508,546 S 8/2005 Oldknow
D508,723 S 8/2005 Rollinson et al.
6,926,615 B1 * 8/2005 Souza ..... A63B 53/0487 473/340
6,929,564 B2 8/2005 Olsavsky et al.
6,960,140 B2 11/2005 Solheim et al.
6,974,394 B1 12/2005 Tang et al.
D513,777 S 1/2006 Cuellar
D514,182 S 1/2006 Olsavsky et al.
6,988,955 B2 * 1/2006 Stoakes ..... A63B 53/0487 473/340
D515,647 S 2/2006 Morgulis
7,004,849 B2 2/2006 Cameron
D517,143 S 3/2006 Petsel et al.
7,018,304 B2 3/2006 Bradford
D519,180 S 4/2006 Oldknow
D520,583 S * 5/2006 Rollinson ..... D21/742
7,052,410 B2 5/2006 Cameron
7,052,411 B2 5/2006 Solheim et al.
D523,102 S * 6/2006 Stites ..... D21/742
7,070,516 B2 7/2006 Dewanjee et al.
7,086,957 B2 8/2006 Solheim et al.
7,115,041 B2 10/2006 Guard et al.
D532,066 S 11/2006 Tang
D532,467 S 11/2006 Aguinaldo et al.
D532,844 S 11/2006 Rollinson
D532,845 S 11/2006 Rollinson
D532,847 S 11/2006 Rollinson
D533,242 S 12/2006 Tang
D533,244 S 12/2006 Kroll, Jr.
D533,613 S 12/2006 Byrne et al.
D533,913 S 12/2006 Byrne et al.

(56) References Cited

U.S. PATENT DOCUMENTS 7,147,569 B2 * 12/2006 Tang ..... A63B 53/0487 473/340
D534,974 S 1/2007 Haack
7,163,469 B2 1/2007 Bonneau
7,166,036 B2 * 1/2007 Byrne ..... A63B 53/0487 473/340
7,166,039 B2 1/2007 Hettinger et al.
7,169,061 B2 1/2007 Hou
D539,860 S 4/2007 Fussell
7,232,379 B2 6/2007 Riseley
D548,295 S 8/2007 Jertson et al.
D548,296 S 8/2007 Rollinson
D549,795 S 8/2007 Rollinson
D552,197 S 10/2007 Wells et al.
D552,699 S 10/2007 Rollinson
D552,700 S 10/2007 Rollinson
D557,361 S 12/2007 Rollinson
D561,282 S 2/2008 Rollinson
D562,926 S 2/2008 Roberts et al.
7,326,121 B2 2/2008 Roake
D564,606 S 3/2008 Oldknow et al.
7,344,451 B2 * 3/2008 Tang ..... A63B 53/0487 473/340
D565,681 S 4/2008 Tanaka
D568,427 S 5/2008 Nguyen et al.
D569,462 S 5/2008 Rollinson
D571,878 S 6/2008 Jones et al.
7,387,580 B2 * 6/2008 Hasegawa ..... A63B 60/02 473/340
D572,331 S 7/2008 Oldknow et al.
D572,780 S 7/2008 Rollinson
D573,673 S 7/2008 Noyes
D574,908 S 8/2008 Hettinger et al.
D575,366 S 8/2008 Rollinson
D577,085 S 9/2008 Nicolette et al.
D577,398 S 9/2008 Hilton
7,435,188 B2 * 10/2008 Tateno ..... A63B 53/0487 473/340
D579,995 S 11/2008 Nicolette et al.
D581,477 S 11/2008 Burdick
7,455,599 B2 11/2008 Jones
D582,497 S 12/2008 Rollinson
7,473,188 B2 * 1/2009 Nishino ..... A63B 53/0487 473/340
7,481,713 B2 * 1/2009 Beckman ..... A63B 53/0487 473/220
7,491,135 B1 * 2/2009 Rollinson ..... A63B 60/54 473/342
D588,657 S 3/2009 Hettinger et al.
D589,575 S 3/2009 Kim et al.
D590,034 S 4/2009 Foster et al.
D590,035 S 4/2009 Hilton
D590,461 S 4/2009 Kim et al.
D590,462 S 4/2009 Hettinger et al.
D591,371 S 4/2009 Hilton
D591,372 S 4/2009 Tang et al.
D591,806 S 5/2009 Cameron
D591,807 S 5/2009 Rollinson
D592,717 S 5/2009 Rollinson
D594,517 S 6/2009 Tang et al.
D595,372 S 6/2009 Rollinson
D595,373 S 6/2009 Kim et al.
7,540,810 B2 6/2009 Hettinger et al.
D595,793 S 7/2009 Rollinson
7,578,752 B1 * 8/2009 Flores ..... A63B 69/3685 473/340
D599,425 S 9/2009 Laub
7,588,499 B2 * 9/2009 Tateno ..... A63B 60/02 473/340
D603,006 S 10/2009 Foster et al.
7,601,076 B2 * 10/2009 Rollinson ..... A63B 53/0487 473/340
7,611,419 B2 * 11/2009 O'Neill ..... A63B 60/00 473/254
7,625,299 B2 * 12/2009 Fujimoto ..... A63B 60/02 473/340
D616,513 S 5/2010 Feret
D617,857 S * 6/2010 Sones ..... D21/746
D619,665 S 7/2010 Rollinson et al.
7,766,762 B2 * 8/2010 Stellander ..... A63B 53/0487 473/254
7,828,675 B2 * 11/2010 Hilton ..... A63B 53/0487 473/340
D630,690 S 1/2011 Rollinson
D634,801 S 3/2011 Rollinson
D635,625 S 4/2011 Rollinson
7,918,745 B2 * 4/2011 Morris ..... A63B 53/04 473/340
D638,892 S 5/2011 Hettinger et al.
D640,341 S 6/2011 Foster et al.
7,955,180 B2 * 6/2011 Bittner ..... A63B 69/3621 473/340
D641,057 S 7/2011 Rollinson
D641,438 S 7/2011 Rollinson
D641,439 S 7/2011 Rollinson et al.
D641,440 S 7/2011 Hettinger et al.
D641,441 S 7/2011 Hilton et al.
D641,442 S 7/2011 Rollinson
D641,814 S 7/2011 Hilton et al.
D641,815 S 7/2011 Rollinson et al.
7,993,217 B2 * 8/2011 Cameron ..... A63B 53/0487 473/340
D650,457 S 12/2011 Rollinson
D650,458 S 12/2011 Rollinson
D650,459 S 12/2011 Rollinson
8,246,481 B2 * 8/2012 Stites ..... A63B 53/007 473/254
8,251,836 B2 * 8/2012 Brandt ..... A63B 53/04 473/340
8,282,501 B2 * 10/2012 Smith ..... A63B 60/00 473/307
8,282,504 B1 * 10/2012 Glaser ..... A63B 53/0466 473/324
8,506,415 B2 * 8/2013 Franklin ..... A63B 53/0487 473/340
D709,971 S * 7/2014 Trahan ..... D21/759
D709,972 S * 7/2014 Trahan ..... D21/759
D709,973 S * 7/2014 Trahan ..... D21/759
8,834,285 B2 * 9/2014 Franklin ..... A63B 53/0487 473/340
8,900,064 B2 * 12/2014 Franklin ..... A63B 53/0487 473/331
8,905,857 B1 * 12/2014 Eckhart ..... A63B 69/3685 473/307
8,956,245 B2 * 2/2015 Brandt ..... A63B 53/04 473/340
D730,462 S * 5/2015 Becktor ..... D21/742
D730,463 S * 5/2015 Dolezel ..... D21/742
9,033,812 B2 5/2015 Solheim et al.
D732,120 S * 6/2015 Becktor ..... D21/742
D732,121 S * 6/2015 Trahan ..... D21/742
D732,122 S * 6/2015 Becktor ..... D21/742
D732,618 S * 6/2015 Becktor ..... D21/742
D749,685 S * 2/2016 Dolezel ..... D21/759
9,283,451 B2 * 3/2016 Kammerer ..... A63B 60/00
D757,193 S 5/2016 Dolezel
D763,987 S 8/2016 Cardani
9,474,948 B2 10/2016 Dolezel et al.
9,522,313 B2 * 12/2016 Betts ..... A63B 53/007
D792,536 S 7/2017 Wang
9,694,259 B2 * 7/2017 Trahan ..... A63B 53/0487
9,782,645 B2 * 10/2017 Dolezel ..... A63B 53/0487
9,839,822 B2 * 12/2017 Becktor ..... A63B 53/0487
10,058,748 B2 * 8/2018 Dolezel ..... A63B 60/52
D835,218 S 12/2018 Rollinson et al.
10,220,273 B2 * 3/2019 Dolezel ..... A63B 53/0487
D844,724 S 4/2019 Wang et al.
10,252,124 B2 * 4/2019 Trahan ..... A63B 53/0487
10,322,324 B2 * 6/2019 Dolezel ..... A63B 53/0487
10,456,637 B2 * 10/2019 Becktor ..... A63B 53/0487
11,020,640 B2 * 6/2021 Higdon ..... A63B 53/0487
11,452,922 B2 * 9/2022 Spackman ..... A63B 53/02

(56) References Cited

U.S. PATENT DOCUMENTS 11,458,375 B2 * 10/2022 Higdon ..... A63B 53/0487
11,813,508 B2 * 11/2023 Higdon ..... A63B 53/0437
11,826,621 B2 * 11/2023 Pedraza ..... A63B 53/0408
11,839,801 B2 * 12/2023 Parsons ..... A63B 53/0487
11,850,482 B2 * 12/2023 Trahan ..... A63B 53/0487
11,865,418 B2 * 1/2024 Lambeth ..... A63B 53/0445
11,911,670 B2 * 2/2024 Serrano ..... A63B 53/0487
11,918,869 B2 * 3/2024 Parsons ..... A63B 53/0487
12,059,604 B2 * 8/2024 Degerness ..... A63B 60/02
12,138,512 B2 * 11/2024 Andrews ..... A63B 60/54
12,145,034 B2 * 11/2024 Becktor ..... A63B 53/0487
12,172,060 B2 * 12/2024 Andrews ..... A63B 53/065
2002/0034986 A1 * 3/2002 Helmstetter ..... A63B 53/0487 473/340
2002/0049093 A1 * 4/2002 Reyes ..... A63B 53/0487 473/340
2003/0036438 A1 * 2/2003 Tang ..... A63B 60/00 473/340
2004/0058743 A1 * 3/2004 Hettinger ..... A63B 53/0487 473/340
2004/0132542 A1 7/2004 Olsavsky et al.
2005/0003902 A1 1/2005 Reese
2005/0014575 A1 * 1/2005 Tang ..... A63B 53/0487 473/340
2006/0094522 A1 * 5/2006 Tang ..... A63B 53/0487 473/340
2006/0287130 A1 12/2006 Allen
2007/0049401 A1 * 3/2007 Tateno ..... A63B 53/0487 473/340
2009/0111605 A1 * 4/2009 Fujimoto ..... A63B 60/02 473/340
2009/0149274 A1 * 6/2009 Rollinson ..... A63B 53/04 473/340
2009/0170629 A1 * 7/2009 Hilton ..... A63B 53/0487 473/340
2009/0170630 A1 * 7/2009 Hilton ..... A63B 60/02 473/340
2009/0215547 A1 8/2009 Hegarty
2010/0173720 A1 7/2010 Kim
2015/0031474 A1 * 1/2015 Franklin ..... A63B 53/0466 473/349
2015/0105178 A1 * 4/2015 Trahan ..... A63B 53/0487 473/340
2015/0105179 A1 * 4/2015 Becktor ..... A63B 53/0487 473/341
2016/0129321 A1 * 5/2016 Dolezel ..... A63B 53/0487 473/340
2016/0346634 A1 * 12/2016 Franklin ..... A63B 53/0487
2017/0209755 A1 * 7/2017 Trahan ..... A63B 53/0487
2017/0312596 A1 * 11/2017 Sandoval ..... A63B 53/04
2018/0001164 A1 * 1/2018 Dolezel ..... A63B 53/0487
2018/0071596 A1 * 3/2018 Becktor ..... A63B 53/0487
2019/0192935 A1 * 6/2019 Trahan ..... A63B 53/0487
2020/0009432 A1 * 1/2020 Becktor ..... A63B 53/0487
2020/0282274 A1 * 9/2020 Spackman ..... A63B 53/08
2021/0001190 A1 * 1/2021 Lambeth ..... A63B 53/0445
2021/0046364 A1 * 2/2021 Mardinly, Sr. ..... A63B 53/04
2021/0245020 A1 * 8/2021 Higdon ..... A63B 53/0487
2021/0362011 A1 * 11/2021 Higdon ..... A63B 53/042
2022/0152464 A1 * 5/2022 Pedraza ..... A63B 53/0408
2022/0161108 A1 * 5/2022 Higdon ..... A63B 53/0437
2023/0014500 A1 * 1/2023 Spackman ..... A63B 53/02
2023/0047363 A1 * 2/2023 Spackman ..... A63B 53/0487
2023/0249039 A1 * 8/2023 Degerness ..... A63B 53/0441 473/341
2023/0347217 A1 * 11/2023 Parsons ..... A63B 53/0487
2023/0364479 A1 * 11/2023 Serrano ..... A63B 53/0487
2023/0405422 A1 * 12/2023 Parsons ..... A63B 53/0445
2024/0017132 A1 * 1/2024 Andrews ..... A63B 60/54
2024/0058662 A1 * 2/2024 Parsons ..... A63B 53/065
2024/0075359 A1 * 3/2024 Higdon ..... A63B 53/0437
2024/0082667 A1 * 3/2024 Trahan ..... A63B 53/0487
2024/0108952 A1 * 4/2024 Lambeth ..... A63B 53/0445
2024/0165466 A1 * 5/2024 Parsons ..... A63B 60/02
2024/0261644 A1 * 8/2024 Serrano ..... A63B 53/02
2024/0293707 A1 * 9/2024 Parsons ..... A63B 53/0487
2024/0350876 A1 * 10/2024 Degerness ..... A63B 53/0408
2024/0367015 A1 * 11/2024 Andrews ..... A63B 60/02

FOREIGN PATENT DOCUMENTS

JP 2008168139 A * 7/2008 ..... A63B 53/04
JP 7390371 B2 * 12/2023 ..... A63B 53/0412
JP 2024016076 A * 2/2024 ..... A63B 53/0412
KR 20160140959 A * 12/2016
KR 101876661 B1 * 7/2018
KR 20210068117 A * 6/2021
KR I731817 B * 6/2021
KR 20230119239 A * 8/2023
TW 202041258 A * 11/2020 ..... A63B 53/02
WO WO-0222217 A1 * 3/2002 ..... A63B 53/0487
WO WO-2006113966 A1 * 11/2006 ..... A63B 69/3685
WO WO-2017143081 A1 * 8/2017 ..... A63B 53/00

OTHER PUBLICATIONS

Jun. 16, 2016 Office Action issued in U.S. Appl. No. 14/311,047.
Oct. 11, 2016 Office Action issued In U.S. Appl. No. 14/166,289.
Dec. 30, 2016 Office Action issued in U.S. Appl. No. 14/311,047.
Dec. 29, 2016 Notice of Allowance issued in U.S. Appl. No. 14/166,289.
Feb. 5, 2018 Office Action Issued in U.S. Appl. No. 15/481,902.
Jun. 22, 2018 Office Action issued in U.S. Appl. No. 15/813,944.
Dec. 27, 2018 Office Action issued in U.S. Appl. No. 15/813,944.
Apr. 13, 2020 Office Action issued in U.S. Appl. No. 16/572,721.
Nov. 2, 2020 Office Action issued in U.S. Appl. No. 16/572,721.
Jun. 8, 2021 Office Action issued in U.S. Appl. No. 16/572,721.
Oct. 28, 2021 Office Action issued in U.S. Appl. No. 16/572,721.
Jun. 30, 2022 Office Action issued in U.S. Appl. No. 16/572,721.
Apr. 28, 2023 Office Action Issued In U.S. Appl. No. 16/572,721.
Sep. 10, 2018 Office Action issued in U.S. Appl. No. 15/481,902.
Mar. 28, 2024 Office Action issued in U.S. Appl. No. 16/572,721.
Jul. 18, 2024 Notice of Allowance issued in U.S. Appl. No. 16/572,721.

* cited by examiner

PUTTER-TYPE GOLF CLUB HEAD

RELATED APPLICATION

This application is a Continuation of U.S. application Ser. No. 16/288,502, filed Feb. 28, 2019, which is a Continuation of U.S. application Ser. No. 15/481,902, filed Apr. 7, 2017, which in turn is a Continuation of U.S. application Ser. No. 14/166,289, filed Jan. 28, 2014, which is based on and claims benefit of U.S. Provisional Application No. 61/891,639, filed Oct. 16, 2013. A claim of priority to these prior applications is hereby made, and the disclosures of these prior applications are hereby incorporated by reference.

BACKGROUND

A critical component of effective putting is the ability to properly align a putter-type golf club with the cup. To better facilitate this proper alignment, various solutions have previously been proposed and manufactured. For example, as evidenced by U.S. Pat. No. D401,636 and D429,297, a putter-type golf club head has been produced with grooves on its upper surface that are perpendicular to the striking face of the club head. As evidenced by U.S. Pat. Nos. 6,905,420 and 6,679,782, a putter-type golf club head has also been produced with a "2-ball" design, in which multiple circular alignment elements are provided on the upper surface of the club head. These circular alignment elements are typically centered on an imaginary line extending rearward and perpendicularly from a center point of the striking face of the putter-type club head. Such design attempts do not, however, adequately provide feedback to the golfer in a manner that avoids strain and unnecessary mental computation. The result is a golfer's loss of confidence in his equipment and greater difficulty in applying a smooth and accurate putting stroke.

SUMMARY

The conventional grooves and circular alignment elements often fail to result in effective alignment of the putter-type golf club head with the cup, thereby frequently resulting in erroneous shots. Accordingly, it is an object of the present invention to provide a putter-type golf club head with more effective alignment elements.

According to experiments carried out by the present inventors, the presence of at least one rectangular alignment element, such as a rectangle or square, allowed a golfer to more effectively align the putter-type golf club head with the cup than the "2-ball" design. One explanation for this improvement is the right-angle characteristic of rectangles and squares, in which one edge of the at least one alignment element was parallel to the striking face of the club head and another edge extended parallel to the travelling direction of the golf ball. Also according to the experiments carried out by the present inventors, by making the width of the at least one alignment element substantially equal to the diameter of the golf ball, heel-to-toe (translational) alignment was improved, thereby further reducing the likelihood of off-centered shots.

Thus, one example of the putter-type golf club head according to one or more aspects of the present invention may include a striking wall having a substantially planar striking face for hitting a golf ball. A central elongate member may extend rearward from the striking wall, and an upper surface of the central elongate member may include a plurality of separate alignment elements. At least one of the plurality of separate alignment elements may have an edge that extends substantially parallel to the striking face, and the length of this edge may be substantially equivalent to the diameter of a golf ball.

In another example, a putter-type golf club head according to one or more aspects of the present invention may include a striking face, a bottom surface, and a top surface opposite the bottom surface. The top surface may include a first alignment element having a generally rectangular shape. The top surface may also include a second alignment element spaced rearwardly from the first alignment element that also has a generally rectangular shape.

To accommodate the alignment elements, the putter-type golf club head, in one example according to one or more aspects of the present invention, may have a length no less than 3.50 inches. The width of the club head may be no less than its length. And the volume of the club head may be no greater than 60 cubic centimeters.

These and other features and advantages of the putter-type golf club head according to the various aspects of the present invention will become more apparent upon consideration of the following description, drawings, and appended claims. The drawings described below are for illustrative purposes only and are not intended to limit the scope of the present invention.

BRIEF DESCRIPTION OF THE DRAWINGS

Exemplary embodiments of the present invention will now be described with reference to the accompanying drawings.

DETAILED DESCRIPTION OF THE EMBODIMENTS

Figure 1:
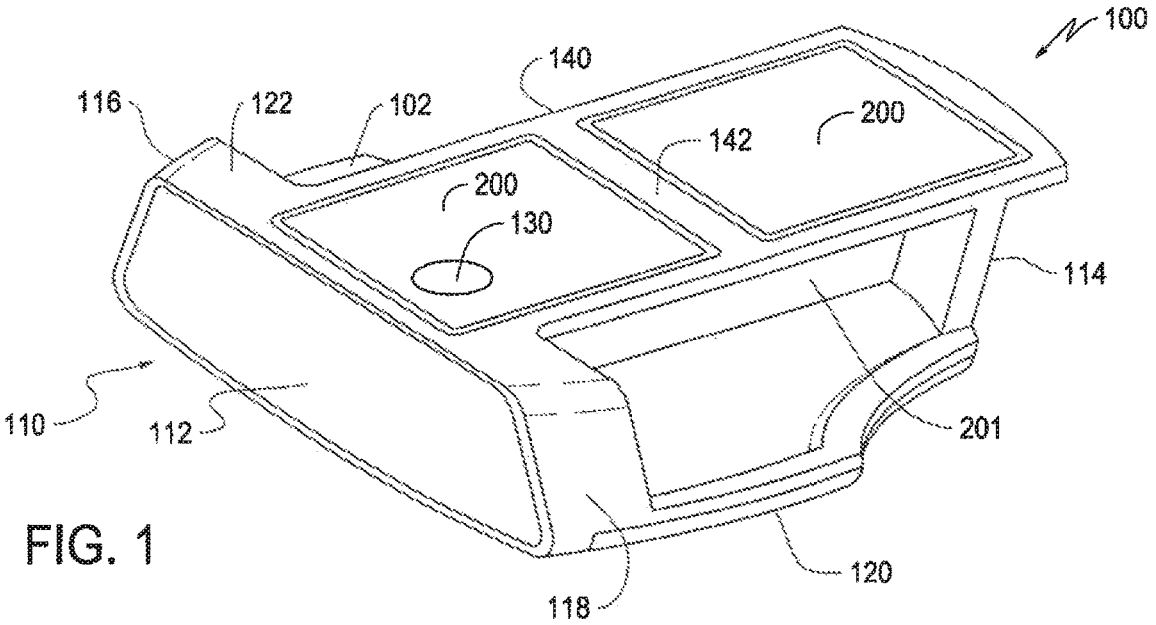
FIG. 1 shows a perspective view of an exemplary putter-type golf club head in accordance with one or more aspects of the present invention.

Referring to FIG. 1, a putter-type golf club head 100, according to one or more aspects of the present invention, may generally include a body 102 formed from metallic and/or non-metallic materials. For example, the body 102 may be formed from any one of or a combination of aluminum, stainless steel, titanium, composites, polymeric materials, and/or any other suitable material. The body 102 may include a front portion 110 having a striking surface 112, a rear portion 114, a toe portion 116, a heel portion 118, a sole portion 120, and an upper portion 122. The heel portion 118 may include a hosel 130, or aperture extending from the exterior surface of the upper portion 122, configured to receive and secure a shaft (not shown) of the golf club.

As shown, the hosel 130 is located toward the heel portion 118 of the club head 100. In certain other aspects, the hosel (or aperture) is located toward the toe portion 116 of the club head 100. In yet other aspects, the hosel (or aperture) is located in a generally central location of the club head 100 relative to the heel to toe direction.

The body 102 may also include a central elongate member 140 projecting from the striking surface 112 of the front portion 110 toward the rear of the body 102. The central elongate member 140 may include a top portion 142, an uppermost surface of which may be substantially planar and may include one or more alignment elements 200. In certain aspects, such as that shown in FIG. 1, the top portion 142 of the central elongate member 140 may be located above, and supported by, a central vertical wall 201 that extends rearwardly from the striking surface 112.

Figure 2:
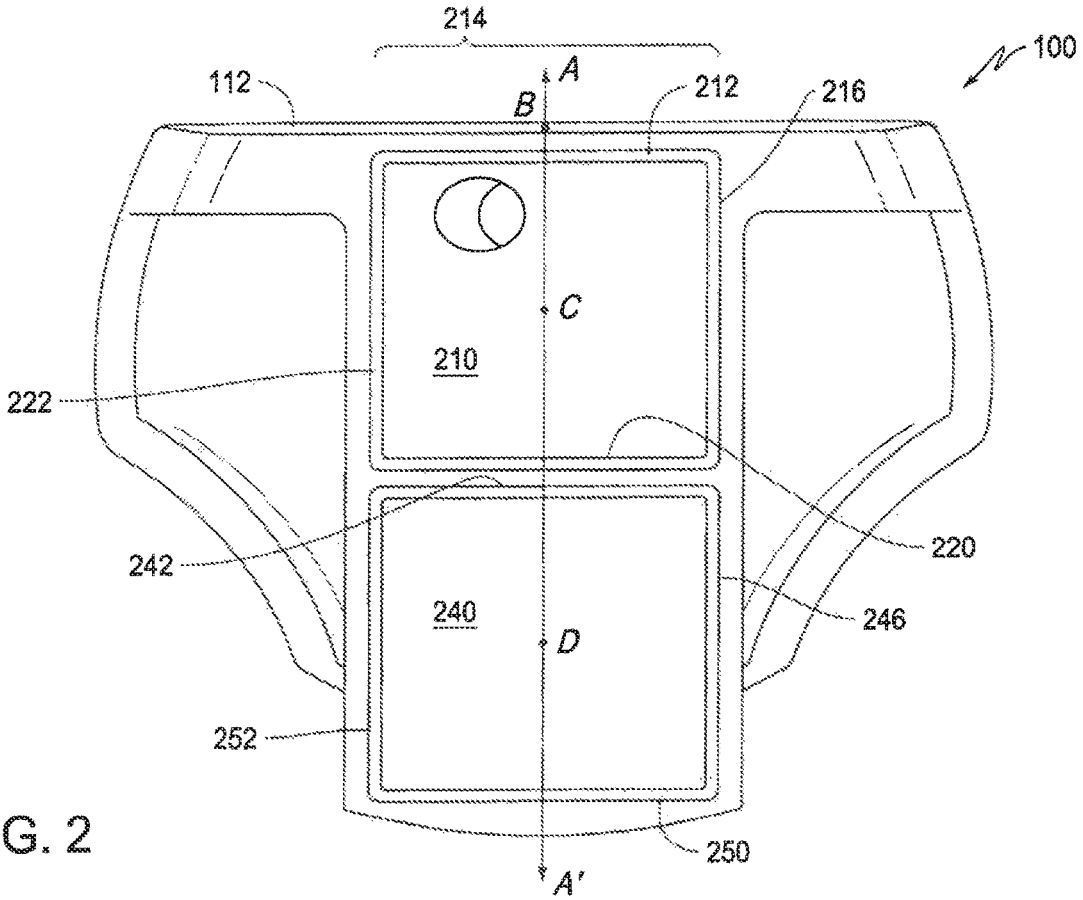
FIG. 2 shows a top plan view of the putter-type golf club head of FIG. 1.

Referring to FIG. 2, the golf club head 100 is shown in top plan view. The golf club head 100 is considered to be "soled" in this orientation with a ground plane being parallel with the plane of the paper. "Soled," as used herein, refers to an orientation of the club head 100 in which equilibrium is achieved with the club head 100 being placed so that the sole portion 120 of the club head 100 is proximate the ground plane. Unless otherwise specified, all club head dimensions described herein are taken with the club head in the "soled" position. In certain aspects, the top portion 142 of the central elongate member 140 may form a generally planar upper surface that is substantially parallel to the ground plane.

The one or more alignment elements 200 may comprise any number and any type of design sufficient to aid a golfer to align the putter-type golf club head 100 with a cup. For example, with further reference to FIG. 2, an alignment element 210 may include an edge 212 substantially parallel to the striking surface 112. An imaginary vertical plane A-A' may be perpendicular to the general plane of the striking surface 112 when the club head 100 is in the "soled" position. The edge 212 may be provided so as to be intersected by the imaginary vertical plane A-A' extending perpendicularly from the striking surface 112 toward the rear portion 114. In certain aspects, the imaginary vertical plane A-A' may intersect a center B of the striking surface 112, and in such cases, it may bisect the edge 212 into two equal halves. The length 214 of the edge 212 may be chosen to facilitate proper alignment of the golf club head 100 with the golf ball. For example, the length 214 may be equal to or substantially equal to the diameter of a golf ball, 1.62 inches ("in"). Alternatively, the length 214 may be slightly more than or slightly less than the diameter of a golf ball.

The alignment element 210 may also include an additional edge 216 that is substantially perpendicular to the edge 212. In certain aspects, the length of the edge 216 may be, like the length 214 of the edge 212, slightly less than, slightly more than, substantially equal to, or equal to the 1.62-in diameter of a golf ball. The alignment element 210 may also include additional edges. For example, the alignment element 210 may include an edge 220 parallel to the edge 212 and may include an edge 222 parallel to the edge 216. Thus, the alignment element 210 may be rectangular in shape. In certain aspects, the edges 212, 216, 220, and 222 may all be equal in length. Accordingly, the alignment element 210 may be square in shape, and its center C may be positioned on the vertical plane A-A'.

The one or more alignment elements 200 may also comprise an additional alignment element 240. For example, with further reference to FIG. 2, the alignment element 240 may be provided rearward of the alignment element 210. This second alignment element 240 may comprise edges 242, 246, 250, and 252. Edge 242, like edge 212 of the alignment element 210, may be provided substantially parallel to the striking surface 112; may have a length that is slightly less than, slightly more than, substantially equal to, or equal to the 1.62-in diameter of a golf ball; and may be bisected into equal halves by imaginary plane A-A'. Edge 246, like edge 216 of the alignment element 210, may be substantially perpendicular to the edge 242 and may, in certain aspects, have a length equal to that of the edge 242. Edges 250 and 252 may be provided so as to be respectively parallel to edges 242 and 246, thereby providing the alignment element 240 with a rectangular shape. In certain aspects, the edges 242, 246, 250, and 252 may be equal in length. Thus, the alignment element 240 may also be square in shape, and its center D may be positioned on the plane A-A'.

The edges of the alignment elements 200 may be of any kind sufficient to delineate the size and shape of the alignment elements 200. The edges may be formed, for example, as edges of shallow grooves in the top portion 142 of the central elongate member 140. These grooves may have a depth of between 0.25 millimeters ("mm") and 1.00 mm extending from the upper surface of the top portion 142 toward the ground plane. More specifically, these grooves may have a depth substantially equal to 0.50 mm. Preferably, the depth of the grooves is selected to be sufficient to enable application and retention of a paint fill.

The presence of the alignment elements 200 on the top portion 142 of the central elongate member 140 may play a role in dictating the shape and dimensions of the putter-type golf club head 100. Notably, the alignment elements 200, as they may comprise plural square-shaped elements with dimensions corresponding to a golf ball diameter, require a relative large area. In turn, these alignment elements 200 may require that a relatively significant amount of mass be placed proximate the top portion 142 of the central elongate member 140. Therefore, given a predetermined mass budget, mass in the remaining regions of the golf club head 100 may preferably be reduced. The walls forming the body 102 of the golf club head 100 may thus be generally thin-walled, and the golf club head 100 may be considered to have a high area (as projected into a ground plane when viewed in top plan) to volume ratio. Similarly, the golf club 100 may be considered to have a high length relative to its volume. Specific dimensions and properties of the golf club head 100 are discussed in detail below.

The term "volume," as used herein, denotes the volume measured using the conventional water displacement method as specified by the United States Golf Association ("USGA") and the R&A Rules Limited ("R&A"), wherein like features of wood type golf club heads are substituted for those of other types of club heads under consideration, say a putter type club head.

Figure 3:
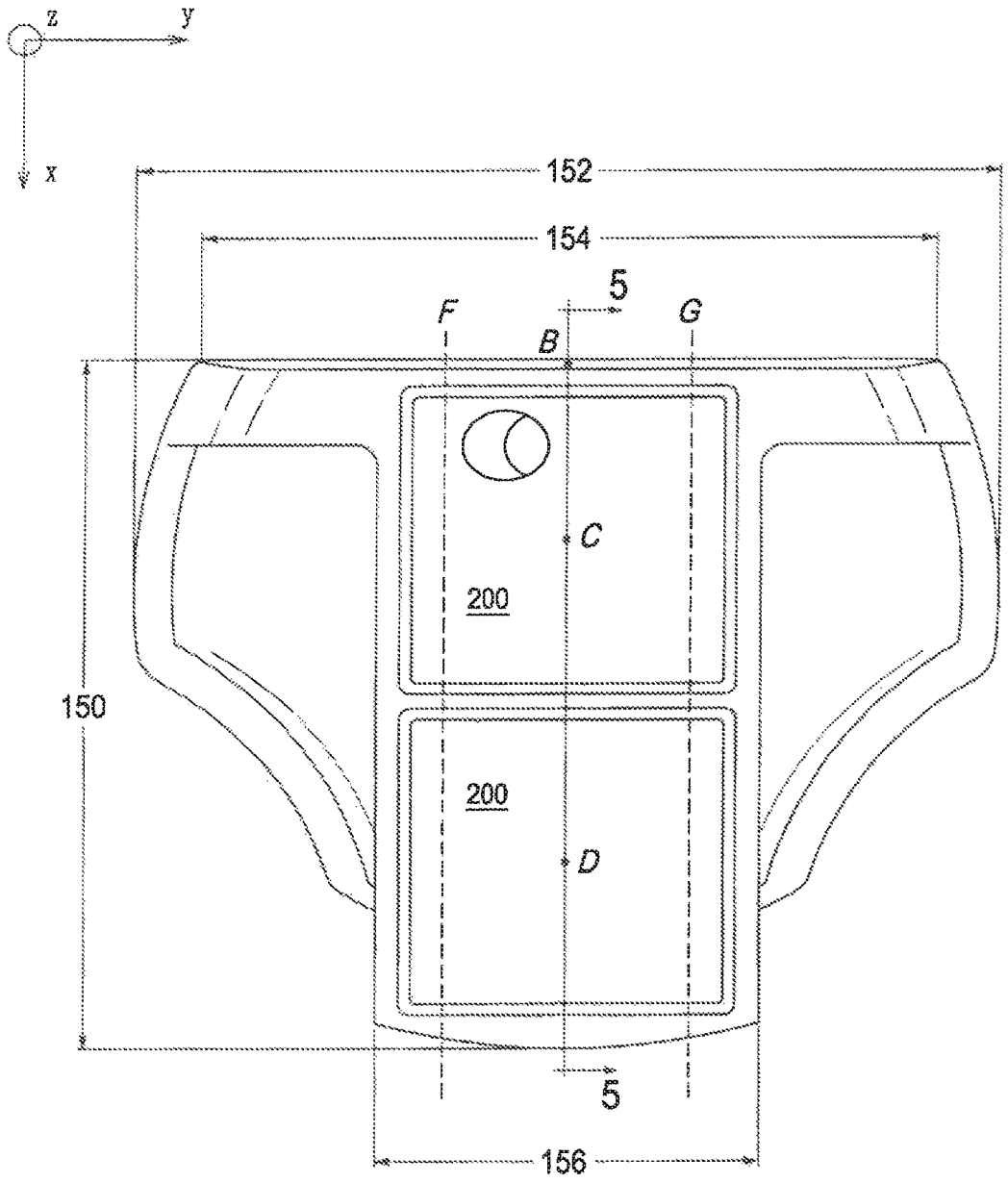
FIG. 3 shows a top plan view of the putter-type golf club head of FIG. 1.

In FIG. 3, the "soled" golf club head 100 of FIG. 2 is shown. With reference to the "x" (i.e. front to rear) direction indicated in FIG. 3, an overall length 150 of the body 102 may be greater than or equal to 3.5 in. More specifically, the length 150 may be greater than or equal to 3.55 in. Even more specifically, the length 150 may be between 3.55 and 4.0 in. With reference to the "y" (i.e. heel to toe) direction perpendicular to the "x" direction, the overall width 152 of the body 102 may be, for example, greater than the length 150. In certain aspects, the width 152 may be greater than or equal to 3.8 in. More specifically, the width 152 may be between 4.0 and 4.5 in. Even more specifically, the width 152 may be between 4.1 and 4.4 in. In certain aspects, the product ("*") of the length 150 and the width 152 may be, for example, greater than or equal to 14 $in^2$. More specifically, the product of the length 150 and the width 152 may be between 14 $in^2$ and 20 $in^2$. These dimensions ensure that the desired alignment elements may be properly sized and positioned in a club head that conforms with USGA regulations (and similar regulations of other golf equipment regulatory bodies). Defining a relatively large projected area when viewed in top plan view also ensures that the club head possesses a sufficiently high moment of inertia to provide adequate performance on off-centered shots.

Other dimensions of the body 102 may also be specified. For example, with further reference to FIG. 3, a width 154 of the striking surface 112, taken in a direction parallel to the width 152, may be less than or equal to the width 152. More specifically, the width 154 may be greater than or equal to 3.8 in. These dimensions ensure compliance with USGA regulations and, also, instill in the golfer a sense of convergence toward a golf cup, when the club head is viewed from above. This is believed to result in improved accuracy. Furthermore, the width 156 of the central elongate member 140, taken in a direction parallel to the widths 152 and 154, may be, for example, less than the widths 152 and 154. In certain aspects, the width 156 may be greater than or equal to 1.0 in. More specifically, the width 156 may be greater than or equal to 1.5 in, or the width 156 may be greater than or equal to 1.75 in. Even more specifically, the width 156 may be between 1.75 and 2.0 in. Finally, the width 156 may be substantially equal to 1.8 in. These parameters, when the club head 100 is viewed from above by a golfer, are believed to ensure continuity between the club head 100 and the golf ball intended to be contacted. Specifically, the bounds of the central elongate member 140, when the club head 100 is in a state of being swung toward a golf ball, are believed to be perceived as motion lines by the golfer. These motion lines could be projected toward the bounds of the golf ball by the golfer with minimal mental exertion. Similarly, having plural alignment elements, when the club head 100 is in a state of being swung toward a golf ball, is believed to provide an indication to the golfer of rate of travel with minimal mental exertion, which minimizes over-hitting. Specifically, the cyclical alternations between the surfaces of the alignment elements and the surrounding environment are believed to readily indicate swing speed. This effect is believed to be even further strengthened by the presence of parallel edges 212, 220, 242, and 250.

The projected area of the club head 100 when "soled" on a ground plane, and when viewed in top plan view, may be, for example, less than the product of the length 150 and the width 152. For example, the projected area of the club head 100 may be greater than or equal to 50% of the product of the length 150 and the width 152. More specifically, the projected area of the club head 100 may be greater than or equal to 65% of the product of the length 150 and the width 152. Even more specifically, the projected area of the club head 100 may be greater than or equal to 75% of the product of the length 150 and the width 152.

Figure 4:
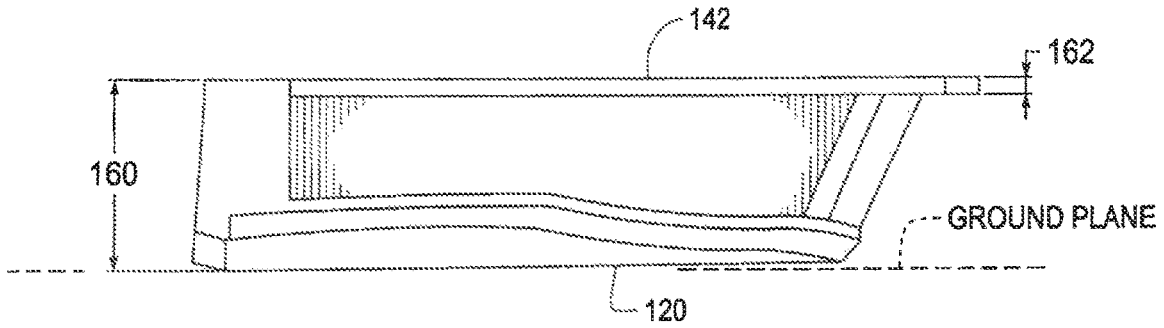
FIG. 4 shows a side view of the putter-type golf club head of FIG. 1.

The height and thickness of the body 102 may also be defined. For example, with reference to FIG. 4, the maximum height 160 from the bottommost point of the sole portion 120 to the uppermost point of the top portion 142 may be greater than or equal to 0.80 in. More specifically, the height 160 may be greater than or equal to 0.85 in. Even more specifically, the height 160 may be greater than or equal to 0.95 in. In certain aspects, the height 160 may be between 0.95 and 1.05 in. The minimum thickness 162 of the top portion 142 may also be specified. For example, the thickness 162 may be less than or equal to 5 mm. More specifically, the thickness 162 may be less than or equal to 3 mm. Even more specifically, the thickness 162 may be between 1 and 3 mm.

Figure 5:
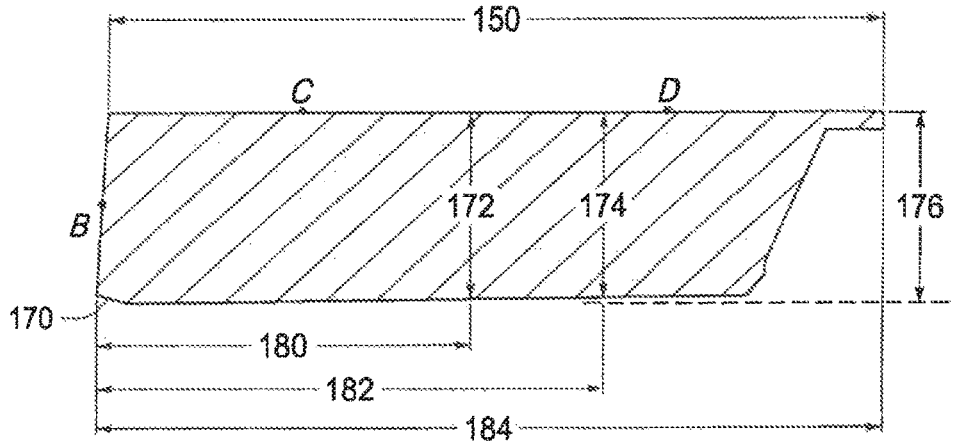
FIG. 5 shows a cross-sectional view taken along the line E-E' of FIG. 3.

FIG. 5 shows a cross-sectional view of the putter-type golf club head 100 along the line E-E' illustrated in FIG. 3. Although the line E-E' is shown as intersecting the center B of the striking surface 112 as well as the centers C and D of the alignment elements 200, this need not be the case. Rather, line E-E' may be positioned anywhere within dashed, imaginary vertical planes F and G, which are each provided 0.5 in from the center B of the striking surface 112. The height 172 is measured at a length 180 (from the forwardmost point 170), which is one half the length 150 of the body 102. The height 172 may be, for example, greater than or equal to the product of 0.5 and the maximum height 160. More specifically, the height 172 may be greater than or equal to the product of 0.75 and the maximum height 160. Even more specifically, the height 172 may be greater than or equal to the product of 0.85 and the maximum height 160. The height 174 is measured at a length 182 (from the forwardmost point 170), which is three quarters the length 150 of the body 102. The height 174 may be, for example, greater than or equal to the product of 0.5 and the maximum height 160. More specifically, the height 174 may be greater than or equal to the product of 0.75 and the maximum height 160. Even more specifically, the height 174 may be greater than or equal to the product of 0.85 and the maximum height 160. Moreover, the height 176 is measured at a length 184 (from the forwardmost point 170), which is equal to the length 150 of the body 102. The height 176 may be, for example, greater than or equal to the product of 0.5 and the maximum height 160. More specifically, the height 176 may be greater than or equal to the product of 0.75 and the maximum height 160. Even more specifically, the height 176 may be greater than or equal to the product of 0.85 and the maximum height 160.

The provision of the alignment elements 200 may in part dictate other properties of the putter-type golf club head 100. For example, the volume V of the golf club head 100 may be less than or equal to 60 cubic centimeters ("cc"). More specifically, the volume V may be less than or equal to 55 cc. Even more specifically, the volume V may be between 40 and 55 cc. In certain aspects, the volume V may be equal to or about 52 cc. The mass M of the golf club head 100 may be, for example, between 300 and 400 grams ("g"). More specifically, the mass M may be between 340 and 380 g. Even more specifically, the mass M may be substantially equal to or about 360 g. These combined mass and volume parameters ensure that, while keeping manufacturing costs low and maintaining a viable overall mass budget, the alignment features described above may be provided.

Furthermore, with reference to FIG. 3, the moment of inertia $I_{xx}$ of the putter-type golf club head 100 about an axis through the center of gravity of the club head 100 and extending parallel to the x-axis may be, for example, greater than or equal to 2,000 g*cm$^2$. The moment of inertia $I_{yy}$ of the golf club head 100 about an axis through the center of gravity of the club head 100 and extending parallel to the y-axis may be, for example, greater than or equal to 2,200 g*cm$^2$. Finally, the moment of inertia $I_{zz}$ of the golf club head 100 about an axis through the center of gravity of the club head 100 and extending parallel to the z-axis may be, for example, no less than 3,500 g*cm$^2$. More specifically, $I_{zz}$ may be no less than 4,000 g*cm$^2$. Even more specifically, $I_{zz}$ may be between 4,000 and 4,500 g*cm$^2$.

In the above discussion, a non-limiting example of the one or more alignment elements 200 has been described. By virtue of the right-angle characteristics of the alignment elements 200, superior alignment of the putter-type golf club head 100 with the cup may be achieved. Moreover, by virtue of the correspondence between the dimensions of the one or more alignment elements 200 and the diameter of the golf ball, heel-to-toe alignment of the golf ball with the golf club head 100 may be improved, thereby increasing the likelihood of an effective shot.

Figure 6:
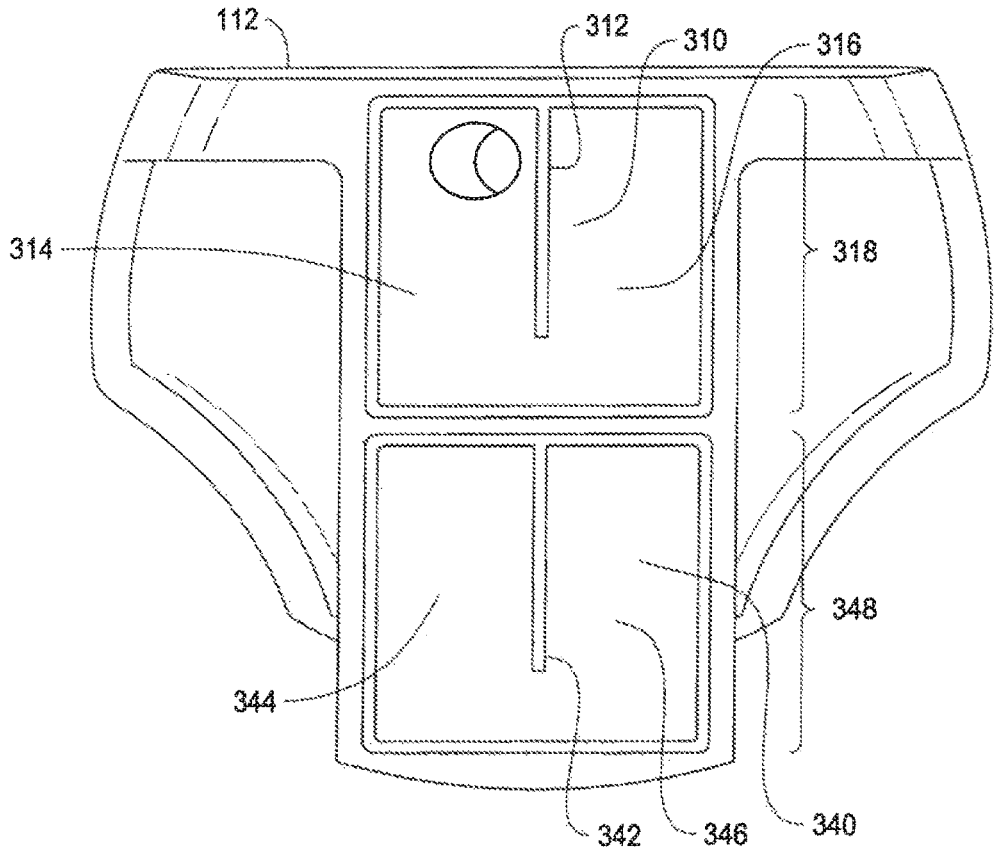
FIG. 6 shows a top plan view of an exemplary putter-type golf club head in accordance with one or more aspects of the present invention.

Other non-limiting examples of the alignment elements are envisioned as being within the scope of the invention. For example, FIG. 6 shows alignment element 310. Alignment element 310 may substantially correspond to alignment element 210 in size and in position on the top portion 142 of the central elongate member 140; however, alignment element 310 may also include a guide line 312. The guide line 312 may be formed in the same manner as the edges of the alignment element 310, say as a groove. As shown in FIG. 6, the guide line 312 may extend perpendicularly to the striking surface 112, and it may run centrally through the alignment element 310 so as to divide the alignment element 310 into two equal portions 314, 316. As shown in FIG. 6, the guide line 312 may extend from the edge of the alignment element 310 closest to the striking surface 112 more than half the length 318 of the alignment element 310 so as to allow the portions 314, 316 to connect. Alternatively, the guide line 312 may extend the entire length 318 of the alignment element 310 so as to completely separate the portions 314, 316. In certain other aspects, the guide line 312 may be intermittent, e.g. dashed.

Another alignment element 340 may also be provided. The alignment element 340 may substantially correspond to alignment element 240 in size and in position on the top portion 142 of the central elongate member 140; however, the alignment element 340 may also include a guide line 342. The guide line 342 may be formed in the same manner as the edges of the alignment element 340, say as a groove. As shown in FIG. 6, the guide line 342 may extend perpendicularly to the striking surface 112, and it may run centrally through the alignment element 340 so as to divide the alignment element 340 into two equal portions 344, 346. As shown in FIG. 6, the guide line 342 may extend from the edge of the alignment element 340 closest to the striking surface 112 more than half the length 348 of the alignment element 340 so as to allow the portions 344, 346 to connect. Alternatively, the guide line 342 may extend the entire length 348 of the alignment element 340 so as to completely separate the portions 344, 346. In certain other aspects, the guide line 342 may be intermittent, e.g. dashed.

Figure 7:
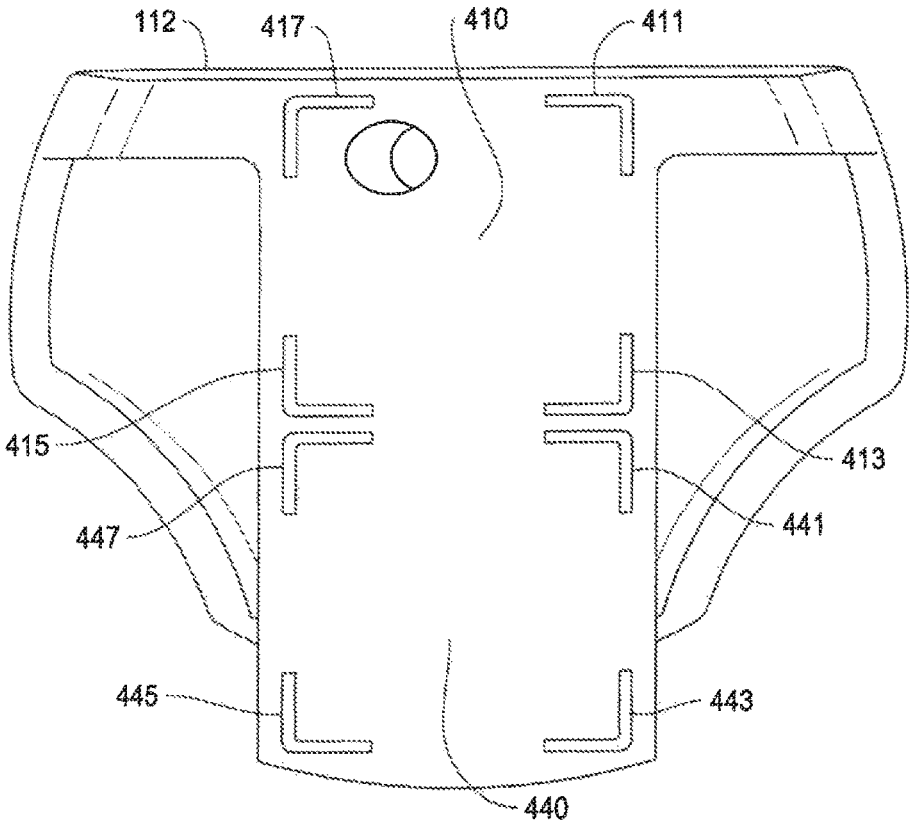
FIG. 7 shows a top plan view of an exemplary putter-type golf club head in accordance with one or more aspects of the present invention.

FIG. 7 shows another non-limiting example of the putter-type golf club head 100 according to the present invention. In this example, at least one of alignment elements 410 and 440 may be provided. Alignment elements 410 and 440 may substantially correspond to alignment elements 210 and 240, respectively, in size and in position on the top portion 142 of the central elongate member 140. The edges of the alignment elements 410 and 440 may substantially correspond to the edges 212, 216, 220, and 222 of the alignment element 210 and to the edges 242, 246, 250, and 252 of the alignment element 240, respectively, in length and in depth of the grooves forming the edges. However, the central portions of these edges may not be recessed into the top portion 142, thereby forming the alignment elements 410 and 440 as a plurality of corners 411, 413, 415, 417, 441, 443, 445, and 447. The lengths of the grooves forming these corners of the alignment elements 410 and 440 need not be particularly limited, for the grooves need only be of sufficient length to delineate to a golfer the orientation and dimensions of the alignment elements 410 and 440. In certain aspects, the portion of each corner parallel to the striking surface 112 may be equal in length to the portion of each corner perpendicular to the striking surface 112. Alternatively, the portion of each corner parallel to the striking surface 112 may be of different length (shorter or longer) than the portion of each corner perpendicular to the striking surface 112. In certain aspects, the grooves forming the plurality of corners 411, 413, 415, 417, 441, 443, 445, and 447 may all be of equal length. Alternatively, certain corners may be of different length than others. For example, corners 411, 417, 441, and 447 may be longer than corners 413, 415, 443, and 445.

Figure 8:
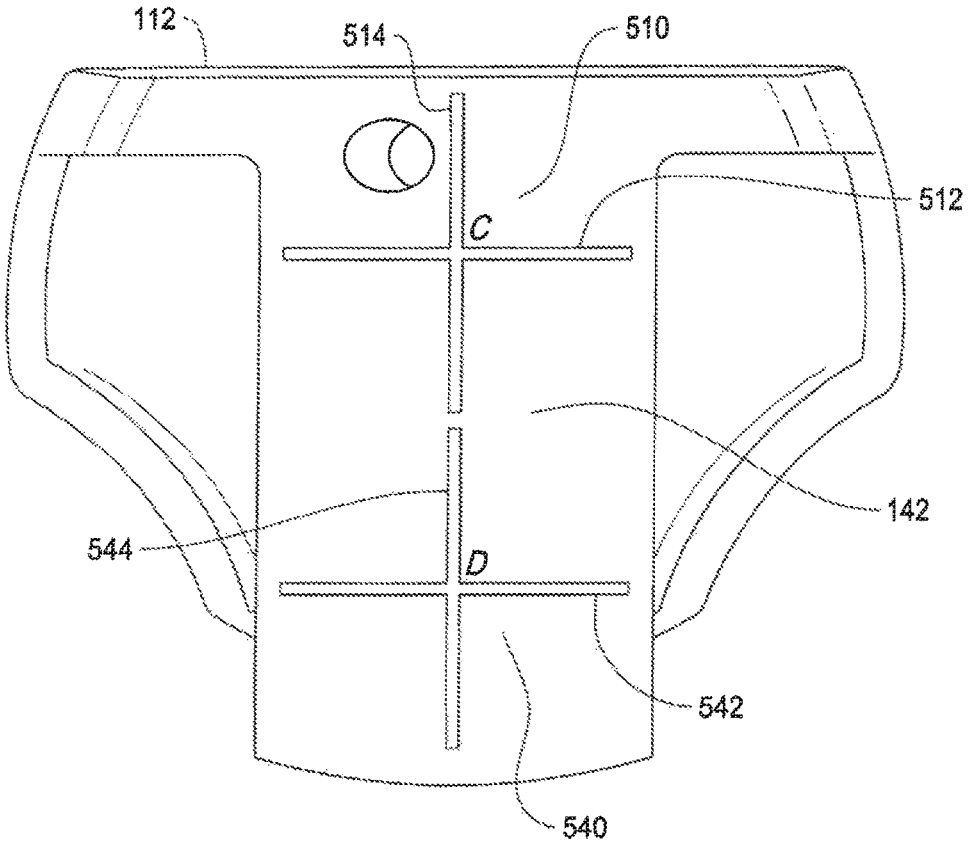
FIG. 8 shows a top plan view of an exemplary putter-type golf club head in accordance with one or more aspects of the present invention.

FIG. 8 shows another non-limiting example of the putter-type golf club head 100 according to the present invention. In this example, at least one of alignment elements 510 and 540 may be provided. Alignment elements 510 and 540 may be provided as "cross-hairs," respectively comprising edges 512, 514 and 542, 544. Edges 512, 514 and 542, 544 may be formed in a manner substantially similar to edges 212, 216, 220, 222, 242, 246, 250, and 252 of the alignment elements 210 and 240. Edges 512 and 542 may be substantially parallel to the striking surface 112, and they may be slightly less than, slightly more than, substantially equal to, or equal to the 1.62 in. diameter of a golf ball. Edges 514 and 544 may be perpendicular to the striking surface 112, and they may respectively intersect the centers of the edges 512 and 542. In certain aspects, edges 514 and 544 may also be slightly less than, slightly more than, substantially equal to, or equal to the 1.62 in. diameter of a golf ball. As seen in FIG. 8, the edges forming the alignment elements 510 and 540 may intersect at points C and D on the top surface 142, points C and D respectively corresponding to the centers of the alignment elements 210 and 240.

Figure 9:
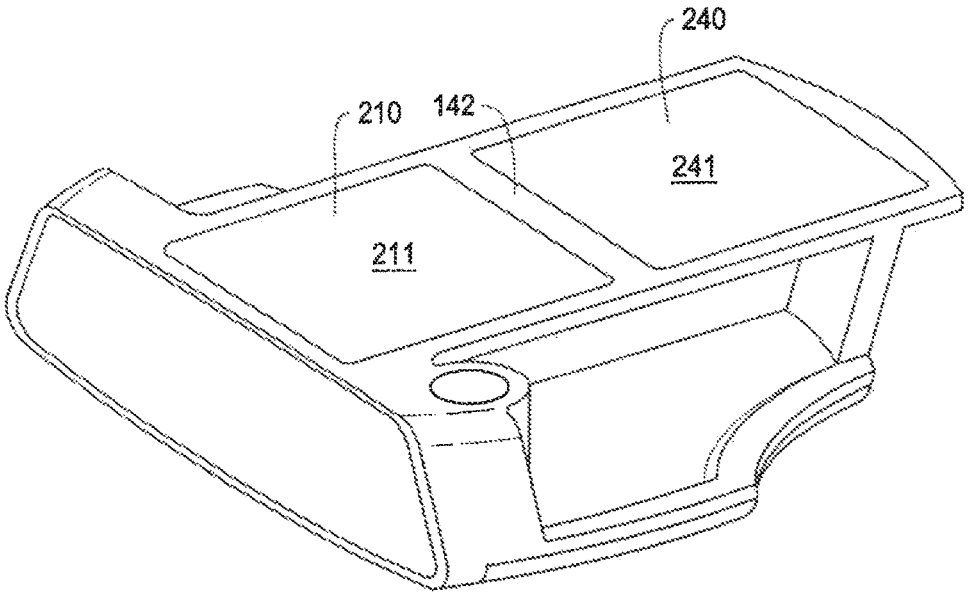
FIG. 9 shows a perspective view of an exemplary putter-type golf club head in accordance with one or more aspects of the present invention.

In the preceding examples, the alignment elements have all been formed by grooves projecting into the top surface 142 of the central elongate member 140. However, this need not be the case. For example, as illustrated in FIG. 9, at least one alignment element may be an insert provided in a corresponding opening in the top surface 142. FIG. 9 shows inserts 211 and 241 respectively forming alignment elements 210 and 240. Examples of materials suitable for fabricating the inserts may include polyurethane, silicone, Nylon, polypropylene (PP), polyethylene (PE), thermoplastic rubber (TPR), thermoplastic vulcanizate (TPV), thermoplastic polyurethane (TPU), thermoplastic elastomers (TPE), and natural rubber. The inserts may be a different color than the body 102 of the club head 100, say white, through painting or doping of the insert with coloring agents, and the inserts may be bonded to the central elongate member 140 using, e.g., an epoxy-type adhesive. The thickness of the inserts is not particularly limited, but in certain aspects, the thickness of the inserts may be less than the thickness 162 of the top portion 142.

Figure 10:
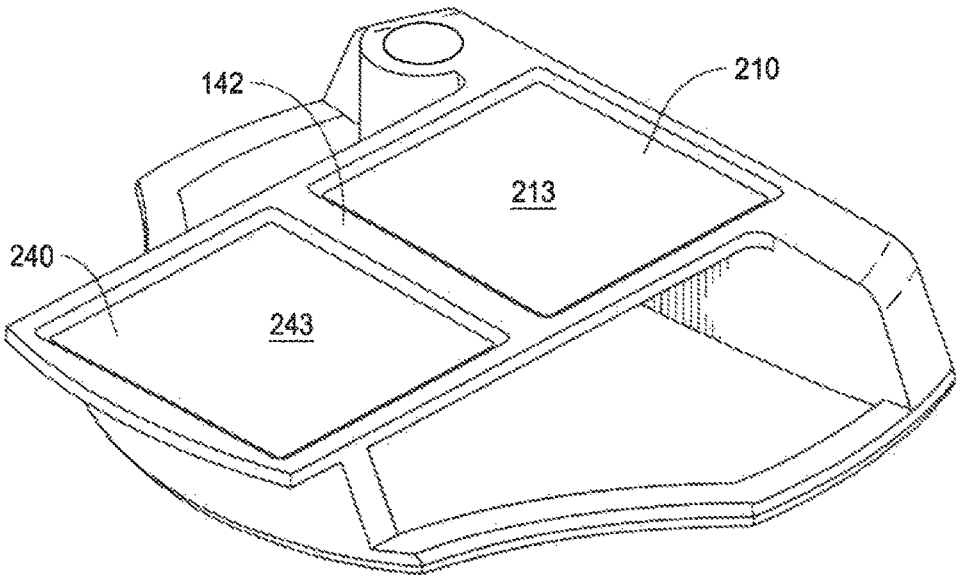
FIG. 10 shows a perspective view of an exemplary putter-type golf club head in accordance with one or more aspects of the present invention.

In other examples, such as that illustrated in FIG. 10, at least one of the alignment elements may be recessed into the top surface 142 of the central elongate member 140. FIG. 10 shows the edges of the alignment elements 210 and 240 not as grooves, but as beveled edges projecting from the uppermost surface of the top portion 142 into the top portion 142. Center, recessed portions 213 and 243 of the alignment elements 210 and 240 are below (i.e. closer to the sole portion 120) than the uppermost surface of the top portion 142. In certain aspects, the beveled edges of the alignment elements 210 and 240 are a different color than the body 102 of the club head 100. In certain other aspects, the center, recessed portions 213 and 243 are a different color than the body 102 of the club head 100. In yet other aspects, both the beveled edges and the center portions 213 and 243 are a different color than the body 102.

Figure 11:
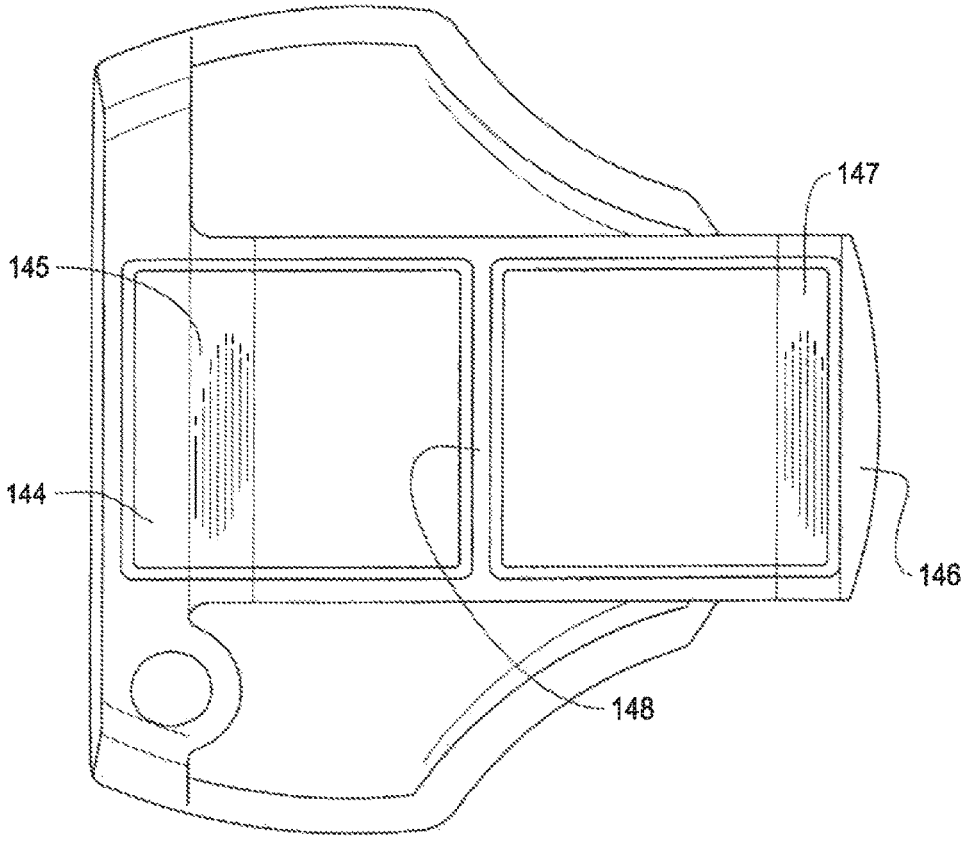
FIG. 11 shows a top plan view of an exemplary putter-type golf club head in accordance with one or more aspects of the present invention.
Figure 12:
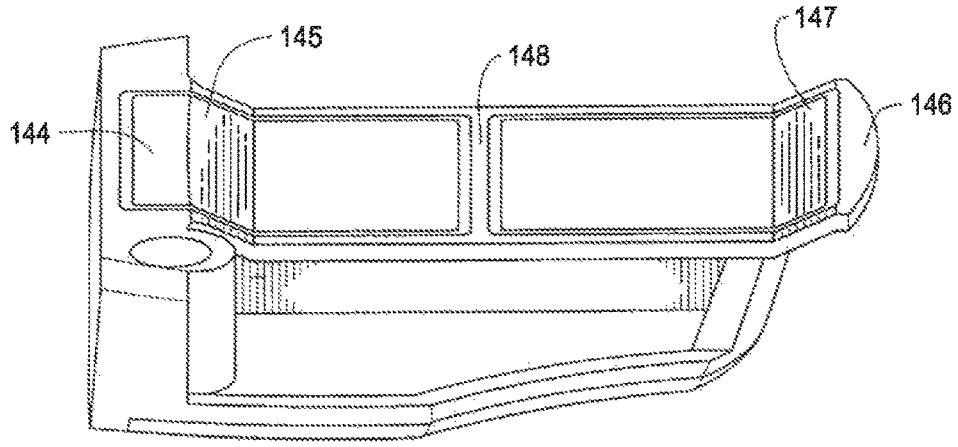
FIG. 12 shows a side perspective view of the putter-type golf club head of FIG. 11.

Even further non-limiting examples are envisioned as being within the scope of the present invention. For example, as shown in FIGS. 11 and 12, the top surface 142 of the central elongate member 140 need not be planar. Rather, the top surface 142 may comprise a front portion 144, a rear portion 146, and a central portion 148 that is recessed from the portions 144, 146 toward the sole portion 120. Beveled connecting portions 145 and 147 may respectively connect the portions 144, 148 and 146, 148. As shown in FIG. 11, when viewed from directly above by a golfer in the reference position, the alignment elements 210 and 240 appear as squares.

In the foregoing discussion, the present invention has been described with reference to specific exemplary aspects thereof. However, it will be evident that various modifications and changes may be made to these exemplary aspects without departing from the broader spirit and scope of the invention. Accordingly, the foregoing discussion and the accompanying drawings are to be regarded as merely illustrative of the present invention rather than as limiting its scope in any manner.

What is claimed is:

1. A putter-type golf club head that, when oriented in a reference position, comprises:

a striking surface having a face center;

a top surface extending rearwardly from the striking surface and including an alignment element having a pair of parallel edges spaced apart from each other by a distance that is substantially the same length as a golf ball diameter, each of the parallel edges extending generally perpendicularly to the striking surface and being laterally offset from the face center;

a club head volume no greater than 60 cc;

a length L and a width W such that L*W is greater than 14 $in^2$;

a mass between 300 g and 400 g; and a moment of inertia, Izz, no less than 3,500 $g*cm^2$, wherein a projected area of the club head in top plan view is greater than or equal to 75% of L*W.

2. The golf club head of claim 1, further comprising a maximum height hmax no less than 0.80 in.

3. The golf club head of claim 1, wherein L*W is less than 20 $in^2$.

4. The golf club head of claim 1, wherein the moment of inertia Izz is no less than 4,000 $g*cm^2$.

5. The golf club head of claim 1, wherein the top surface is generally planar.

6. The golf club head of claim 1, wherein the alignment element comprises a geometric center that lies in a virtual vertical plane that is generally perpendicular to the striking surface and passes through the face center.

7. The golf club head of claim 1, wherein the golf club head has an outer perimeter in the top plan view, and in the top plan view, an area circumscribed by the outer perimeter is entirely filled by the golf club head.

8. A putter-type golf club head that, when oriented in a reference position, comprises:

a striking wall with a striking surface including a face center;

a central elongate member (i) extending rearwardly from the striking wall, (ii) having a lateral width greater than 1.5 in, and (iii) including an alignment element formed in a top wall, the alignment element having a pair of parallel edges extending generally perpendicularly to the striking surface and laterally offset from the face center;

a club head volume no greater than 60 cc;

a length L and a width W such that L*W is greater than 14 $in^2$;

a mass between 300 g and 400 g; and a moment of inertia, Izz, no less than 3,500 $g*cm^2$, wherein a projected area of the club head in top plan view is greater than or equal to 75% of L*W.

9. The golf club head of claim 8, wherein the parallel edges of the alignment element are spaced apart from each other by a distance that is substantially the same length as a golf ball diameter.

10. The golf club head of claim 8, wherein L*W is less than 20 $in^2$.

11. The golf club head of claim 8, wherein the alignment element comprises a geometric center that lies in a virtual vertical plane that is generally perpendicular to the striking surface and passes through the face center.

12. The golf club head of claim 8, wherein the golf club head has an outer perimeter in the top plan view, and in the top plan view, an area circumscribed by the outer perimeter is entirely filled by the golf club head.

13. A putter-type golf club head that, when oriented in a reference position, comprises:

a striking surface extending in a heel-to-toe direction and having a face center;

a top surface extending rearwardly from the striking surface;

a first alignment element in the top surface and a second alignment element in the top surface spaced rearward of the first alignment element;

a volume no greater than 60 cc;

a length L and a width W such that L is no greater than W and L*W is greater than 14 $in^2$;

a mass between 300 g and 400 g; and a moment of inertia, Izz, no less than 3,500 $g*cm^2$, wherein a projected area of the club head in top plan view is greater than or equal to 75% of L*W.

14. The golf club head of claim 13, wherein the first alignment element comprises a pair of parallel edges extending perpendicularly to the striking surface and being laterally offset from the face center.

15. The golf club head of claim 13, further comprising a maximum height hmax no less than 0.80 in.

16. The golf club head of claim 13, wherein L*W is less than 20 $in^2$.

17. The golf club head of claim 13, wherein the moment of inertia, Izz, is no less than 4,000 g*cm$^2$.

18. The golf club head of claim 13, wherein the top surface is generally planar.

19. The golf club head of claim 13, wherein the alignment element comprises a geometric center that lies in a virtual vertical plane that is generally perpendicular to the striking surface and passes through the face center.

20. The golf club head of claim 13, wherein the golf club head has an outer perimeter in the top plan view, and in the top plan view, an area circumscribed by the outer perimeter is entirely filled by the golf club head.

* * * * *